US009306321B2

(12) United States Patent
Shimada

(10) Patent No.: US 9,306,321 B2
(45) Date of Patent: Apr. 5, 2016

(54) ELECTRIC CONNECTOR

(75) Inventor: Yoshinobu Shimada, Machida (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 13/816,943

(22) PCT Filed: Aug. 2, 2011

(86) PCT No.: PCT/JP2011/067655

§ 371 (c)(1),
(2), (4) Date: Feb. 14, 2013

(87) PCT Pub. No.: WO2013/018193

PCT Pub. Date: Feb. 7, 2013

(65) Prior Publication Data

US 2013/0143429 A1 Jun. 6, 2013

(51) Int. Cl.

| | |
|---|---|
| ***H01R 12/88*** | (2011.01) |
| ***H01R 13/62*** | (2006.01) |
| *H01R 13/447* | (2006.01) |
| *H01R 12/79* | (2011.01) |

(52) U.S. Cl.

CPC ..... *H01R 13/62* (2013.01); *H01R 12/88* (2013.01); *H01R 12/79* (2013.01); *H01R 13/447* (2013.01)

(58) Field of Classification Search

CPC ..... H01R 12/88; H01R 13/44; H01R 13/447
USPC ..... 439/492, 495, 263, 260
See application file for complete search history.

(56) References Cited

U.S. PATENT DOCUMENTS

| | | | | |
|---|---|---|---|---|
| 6,394,838 | B1 * | 5/2002 | Yen | 439/492 |
| 7,291,040 | B2 * | 11/2007 | Kato | 439/495 |
| 7,632,136 | B2 * | 12/2009 | Hemmi et al. | 439/495 |
| 7,833,041 | B2 * | 11/2010 | Ono et al. | 439/329 |
| 7,955,107 | B1 | 6/2011 | Pao et al. | |
| 2006/0089036 | A1 | 4/2006 | Takai et al. | |
| 2012/0322293 | A1 | 12/2012 | Shimada et al. | |

FOREIGN PATENT DOCUMENTS

| | | |
|---|---|---|
| CN | 101567497 A | 10/2009 |
| JP | 62 154482 | 7/1987 |

(Continued)

OTHER PUBLICATIONS

International Search Report Issued Oct. 18, 2011 in PCT/JP11/67655 Filed Aug. 2, 2011.

(Continued)

*Primary Examiner* — Felix O Figueroa
(74) *Attorney, Agent, or Firm* — Oblon, McClelland, Maier & Neustadt, L.L.P.

(57) ABSTRACT

To prevent, with a simple structure, damage on a component such as a conductive contact at the time of operation of an actuator, an actuator pinching a signal transmission medium by being moved to a connection acting position facing a wiring board is provided with a protective projection protruding toward the wiring board with the actuator being moved to the connection acting position. With this, a gap between the actuator and the printed wiring board is covered with the protective projection from outside, the components such as conductive contacts disposed inside the gap between the actuator and the printed wiring board are prevented from being in contact with a nail of an operator.

7 Claims, 15 Drawing Sheets

(56) References Cited

FOREIGN PATENT DOCUMENTS

| | | |
|---|---|---|
| JP | 2004 071160 | 4/2004 |
| JP | 2006 147523 | 6/2006 |
| JP | 2007 179808 | 7/2007 |
| JP | 2011 165397 | 8/2011 |
| JP | 2011 181492 | 9/2011 |

OTHER PUBLICATIONS

Combined Chinese Office Action and Search Report issued Nov. 15, 2014 in Patent Application No. 201180048053.5 (with English translation of categories of cited documents).
Office Action issued Feb. 4, 2015, in European Patent Application No. 11870311.5.

* cited by examiner

ELECTRIC CONNECTOR

BACKGROUND OF THE INVENTION

1. Field of the Invention

The present invention relates to an electric connector configured so as to fix a signal transmission medium by moving an actuator.

2. Description of the Related Art

In general, in various electric apparatuses and others, various electric connectors are widely used to electrically connect various signal transmission media such as a flexible printed circuit (FPC) and a flexible flat cable (FFC). For example, in an electric connector for use as being mounted on a printed wiring board as described in Japanese Unexamined Patent Application Publication No. 2004-71160, a signal transmission medium formed of an FPC, an FFC, or the like is inserted into the inside of an insulating housing (an insulator) from its opening on a front end side, and then an actuator (connecting operation device) held at a "connection release position" is rotated so as to be, for example, pushed down, toward a connecting action position on a front side or a rear side of the connector with an operating force of an operator.

When the actuator (connecting operation device) is operated to be rotated to a "connection acting position", a cam member provided in the actuator presses conductive contacts. With this, the conductive contacts are displaced to be in press-contact with the signal transmission medium (such as FPC or FFC), thereby fixing the signal transmission medium. On the other hand, when the actuator at the "connection acting position" is rotated toward the original "connection release position" so as to, for example, rise upward, the conductive contacts are displaced so as to be spaced apart by their elasticity from the signal transmission medium (such as FPC or FFC), thereby causing the signal transmission medium to become in a free state.

As such, the actuator for the electric connector is operated to reciprocate between the "connection release position" and the "connection acting position" as, for example, being rotated. The actuator in the state of being moved to the "connection acting position" is disposed to be close to the printed wiring board. In particular, since the size and height of electric connectors have been significantly decreased in recent years, a gap between the actuator at the connection acting position and the printed wiring board has become extremely small. To operate this actuator in close contact with the printed wiring board, for example, as depicted in FIG. 13 showing an embodiment of the present invention, a rotating operation is often performed in which a nail of an operator is inserted in a narrow gap between the actuator and a printed wiring board P and a nail tip part of the operator is hooked at the actuator.

However, since components such as conductive contacts are disposed in the gap between the actuator and the printed wiring board, if the nail of the operator is inserted between the actuator and the printed wiring board as described above, the nail tip part of the operator may be caught in an end of a conductive contact or the like and, if the operation continues as it is, a component of the electric connector may be damaged. For example, when the actuator is rotated so as to rise upward from the "connection acting position" to the "connection release position", the nail tip part of the operator is caught in a tip portion of a conductive contact protruding from a through hole in the actuator on a back side of the actuator and then the operation continues, thereby possibly damaging a component of the electric connector.

SUMMARY OF THE INVENTION

Therefore, an object of the present invention is to provide an electric connector capable of preventing, with a simple structure, damage on a component such as a conductive contact at the time of operation of an actuator.

To achieve the above-described object, in the present invention, in an electric connector for use as being mounted on a printed wiring board so as to connect a signal transmission medium to a wiring board side, the electric connector configured so that an actuator pinches a signal transmission medium by being moved to a connection acting position so as to face the wiring board, a structure is adopted in which the actuator is provided with a protecting part protruding toward the wiring board with the actuator being moved to the connection acting position.

According to the present invention with the above-described structure, with the actuator being moved to the connection acting position, the gap formed between the actuator and the printed wiring board is covered with the protecting part from an operation-side outer end face side of the actuator. With this, a chance is eliminated that a nail of the operator is in contact with a connector component such as a conductive contact disposed inside the gap between the actuator and the printed wiring board.

Also, the protecting part in the present invention is preferably provided so as to form a step on an operation-side outer end face of the actuator.

According to the present invention with the above-described structure, when an operation of moving the actuator is performed, a nail tip part of the operator is easily hooked at the step between the actuator and the protecting part, and thus the operation of moving the actuator is safely and reliably performed.

Still further, preferably in the present invention, the actuator is mounted on an insulating housing so as to be able to reciprocate, a plurality of conductive contacts in contact with the signal transmission medium and the wiring board are disposed in the insulating housing in a multi-contact manner, the conductive contacts each have a board connecting part solder-jointed to the wiring board, and the protective projection is disposed at a portion between board connecting parts of adjacent ones of the conductive contacts in a multi-contact arrangement direction.

According to the present invention with the above-described structure, when the actuator is moved to the connection acting position, the protecting part of the actuator enters the portion between the board connecting parts of the conductive contacts to prevent interference between the actuator and the conductive contacts. Therefore, even if the actuator is reduced in a length direction of the conductive contacts orthogonal to the multi-contact arrangement direction, no interference occurs. Also, the portion between the board connecting parts of the conductive contacts is covered with the protecting part of the actuator, and thus a situation is prevented that a foreign substance such as dust enters that portion to cause an electric short circuit.

Furthermore, the protecting part in the present invention is preferably disposed to protrude to an operation-side outer end face side of the actuator with the actuator being moved from an end face of a board connecting part of each of the conductive contacts to the contact acting position.

According to the present invention with the above-described structure, the nail tip part of the operator is in contact with the protecting part of the actuator to disable further insertion. With this, the nail tip part of the operator is reliably prevented from being in contact with an end face of the board connecting part of a conductive contact.

Still further, preferably in the present invention, the actuator is mounted on an insulating housing so as to be able to reciprocate, and the protecting part is disposed at a position not interfering with the insulating housing in a reciprocating direction of the actuator.

According to the present invention with the above-described structure, it is not required to decrease the size of the insulating housing to avoid interference with the protecting part of the actuator and, accordingly, the ability of holding the conductive contacts is excellently kept.

Still further, preferably in the present invention, the actuator is provided so as to be able to rotate about a rotation center extending in a longitudinal direction of the actuator, and inclined surface parts extending to form an appropriate angle with respect to the longitudinal direction are provided on both end portions of the actuator in the longitudinal direction on an outer-side end face in a radial direction with respect to the rotation center of the actuator.

According to the present invention with the above-described structure, in order to rotate the actuator from the "connection release position" to the "connection acting position", when a front end face of the actuator with the actuator standing at the "connection release position" is pressed with a fingertip of the operator, the pressing force of the operator is difficult to be exerted onto a portion where the inclined surface parts are provided on both end sides in the longitudinal direction. For this reason, the pressing force tends to be loaded onto the center portion of the actuator in the longitudinal direction. Also, the pressing force loaded onto portions where the inclined surface parts are provided is acted in an approximately right angle direction with respect to the inclined surfaces of the inclined surface parts, that is, toward the both end sides to a center side in the longitudinal direction of the actuator. For this reason, the pressing force by the operator as a whole is approximately uniformly acted over a full length of the actuator, making it difficult to cause a conventional situation that the actuator is pressed as being twisted. The actuator is rotated as a whole by keeping an approximately flat plane, and an operation of pinching the signal transmission medium by the rotation of the actuator is excellently performed.

Furthermore, when the outer appearance of the actuator is viewed, it is visually recognized as an odd form having an approximately trapezoidal shape. Therefore, the rotation state of the actuator is easily and reliably checked.

As described above, in the electric connector according to the present invention, the protecting part protruding toward the wiring board with the actuator being moved to the connection acting position is provided in the actuator pinching the signal transmission medium by being moved to the connection acting position so as to face the wiring board. With this the gap between the actuator and the printed wiring board is covered with the protecting part from outside, and a chance is eliminated that a nail of the operator is in contact with a component such as a conductive contact disposed inside the gap between the actuator and the printed wiring board. Thus, damage on a component such as a conductive contact at the time of operation of the actuator can be reliably prevented with a simple structure, and the quality and reliability of the electric connector can be significantly improved at low cost.

DETAILED DESCRIPTION OF THE PREFERRED EMBODIMENT

Figure 1:
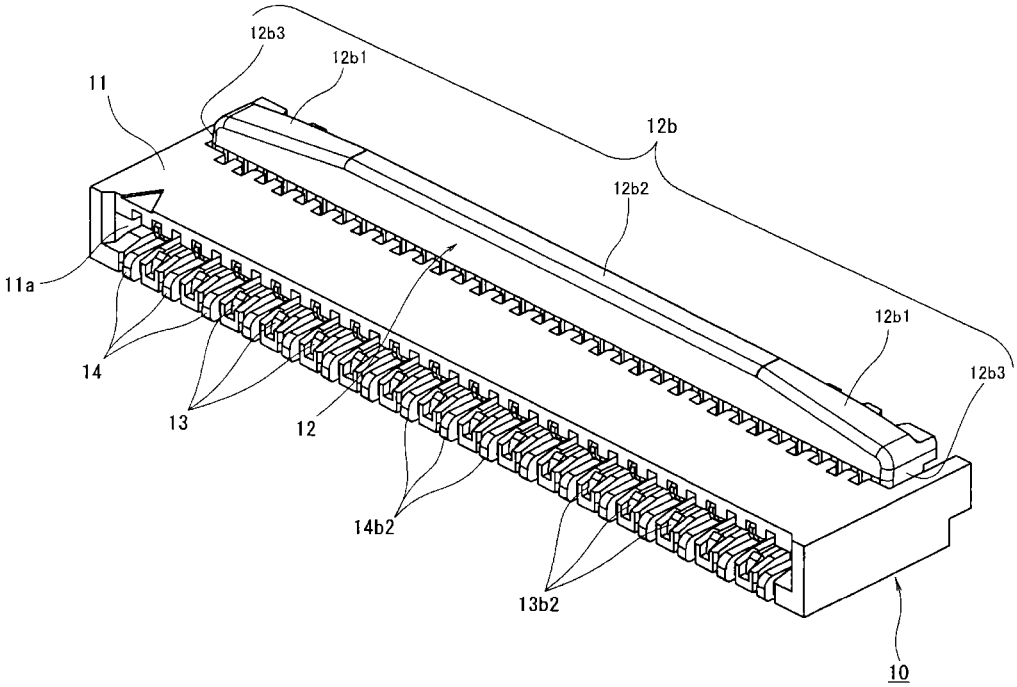
FIG. 1 is a descriptive external perspective view of an electric connector according to an embodiment of the present invention, showing an entire structure when viewed from a front side in the state where an actuator stands at a connection release position with a signal transmission medium not being inserted.
Figure 2:
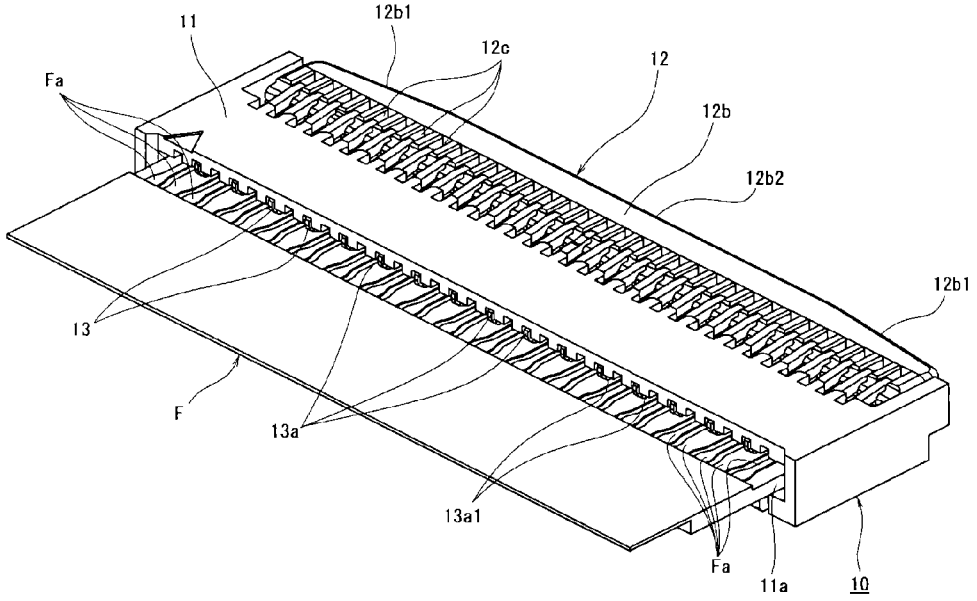
FIG. 2 is a descriptive external perspective view of the entire structure when viewed from the front side in the state where the signal transmission medium is inserted in the electric connector depicted in FIG. 1 and then the actuator is rotated so as to be pushed down to a connection acting position.
Figure 3:
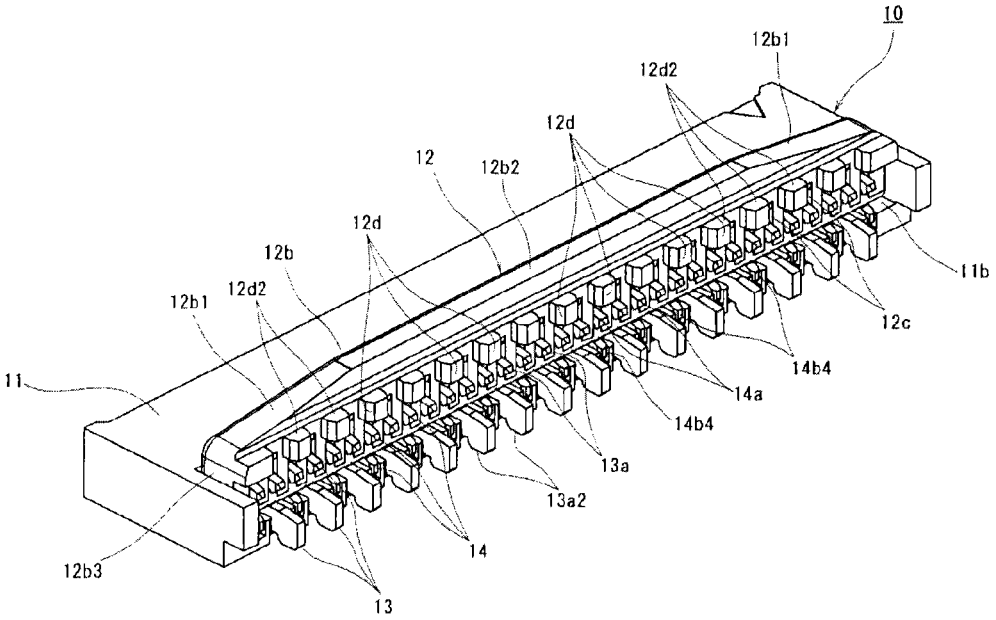
FIG. 3 is a descriptive external perspective view of the electric connector in a connection release state depicted in FIG. 1 when viewed from a rear side.
Figure 4:
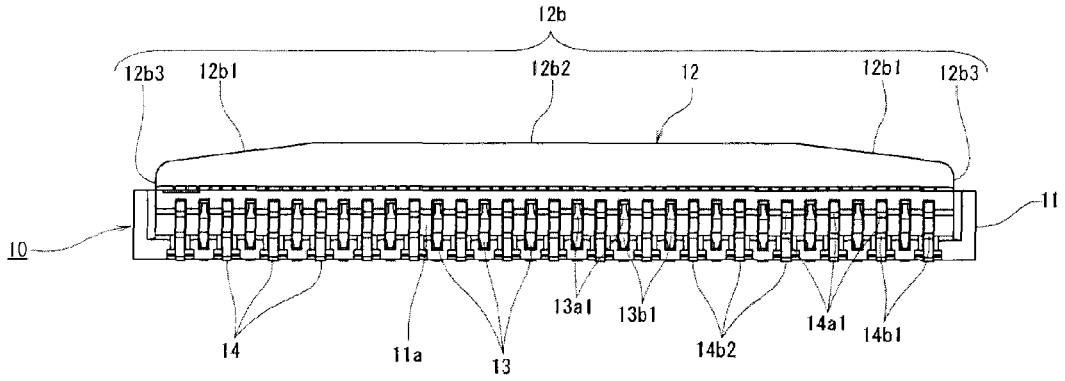
FIG. 4 is a descriptive front view of the electric connector in the connection release state depicted in FIG. 1 when viewed from a front side.
Figure 5:
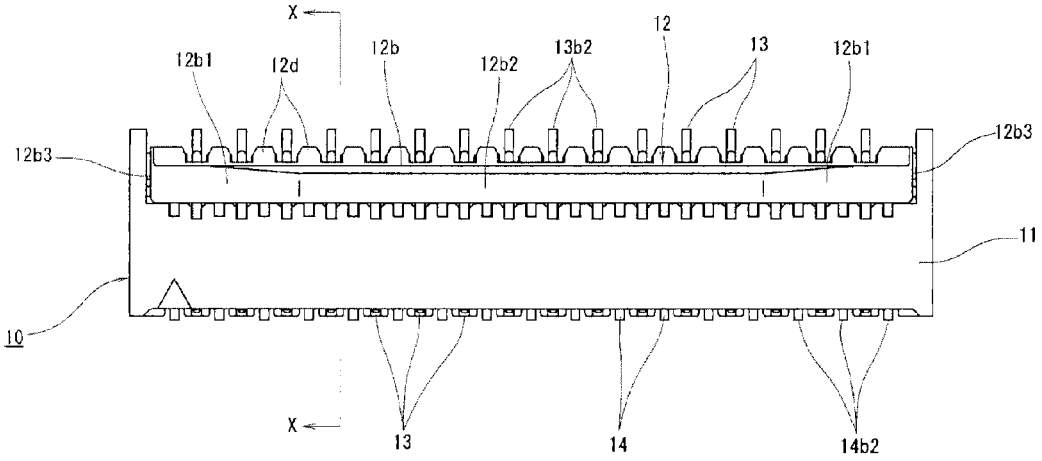
FIG. 5 is a descriptive plan view of the electric connector in the connection release state depicted in FIG. 1 when viewed from an upper side.
Figure 6:
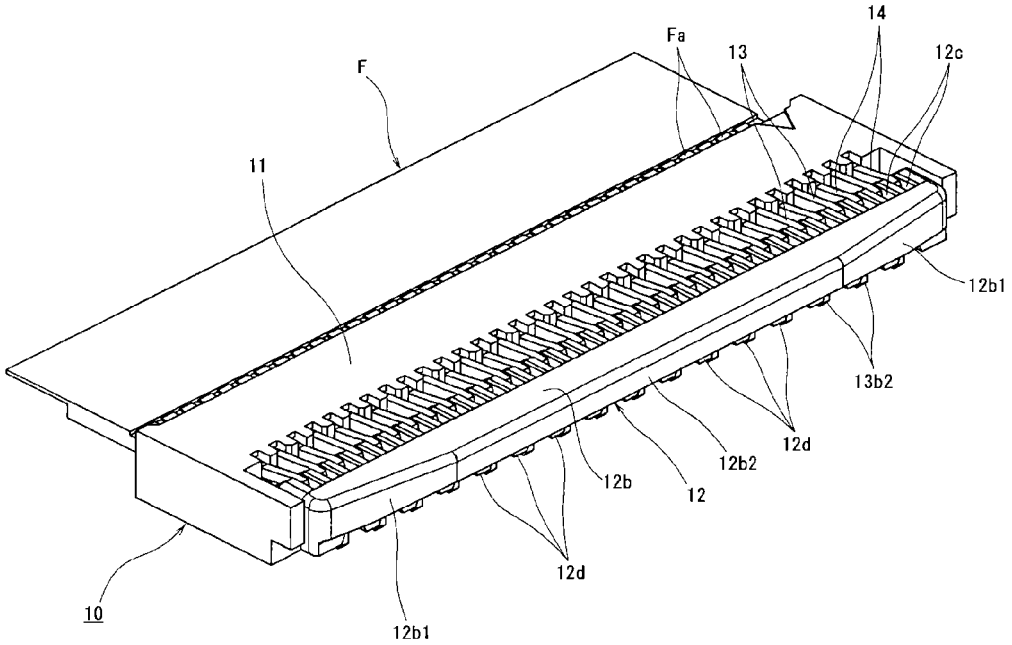
FIG. 6 is a descriptive external perspective view of the electric connector in a connection acting state depicted in FIG. 2 when viewed from a rear side.

An embodiment is described in detail below based on the drawings, in which the present invention is applied to an electric connector for use as being mounted on a wiring board for connecting a signal transmission medium formed of a flexible printed circuit (FPC), a flexible flat cable (FFC), or the like.

That is, an electric connector 10 depicted in FIG. 1 to FIG. 17 is formed of a so-called back-flip-type structure in which an actuator 12 as connecting operation device is provided on a rear end edge side (a right end edge side in FIG. 10) of an insulating housing 11. The actuator 12 described above is configured to be rotated so as to be pushed down toward a rear side (a right side in FIG. 10) opposite to a connector front end side (a left end side in FIG. 10) in which a terminal portion of a signal transmission medium (such as FPC or FFC) F is inserted.

Here, while the insulating housing 11 is formed of a hollow-frame-shaped insulating member extending in an elongated shape, a longitudinal breadth direction of the insulating housing 11 is hereinafter referred to as a connector longitudinal direction, and a direction in which the terminal portion of the signal transmission medium (such as FPC or FFC) F is inserted or disengaged is hereinafter referred to as a connector front-back direction.

Description is now made more specifically. In the inside of the insulating housing 11 described above, a plurality of conductive contacts 13 and 14 having two different shapes each formed of a thin-plate-like metal-made member having an appropriate shape are mounted. The conductive contacts 13 and 14 are disposed in a multi-contact manner as being spaced apart from each other along the connector longitudinal direction inside the insulating housing 11. The conductive contacts 13 on one side and the conductive contacts 14 on the other side that have different shapes are alternately arranged in the connector longitudinal direction, which is a direction of multi-contact arrangement. These conductive contacts 13 and 14 are each used as either a contact for signal transmission or a contact for ground connection as being mounted by solder joint on a conductive path (not shown) formed on a main printed wiring board (refer to a reference character P in FIG. 12 and FIG. 13).

On a front end edge side of the insulating housing 11 (a left end edge side in FIG. 10), a medium insertion opening 11*a* in which the terminal portion of the signal transmission medium F formed of a flexible printed circuit (FPC), a flexible flat cable (FFC), or the like as described above is inserted is provided so as to form a horizontally elongated shape in the connector longitudinal direction. On its opposite rear end edge side (the right end edge side in FIG. 10) in the connector front-back direction, a component mount opening 11*b* for mounting the conductive contacts 13 on one side described above, the actuator (connecting operation device) 12, and others is provided so as also to form a horizontally elongated shape.

Figure 10:
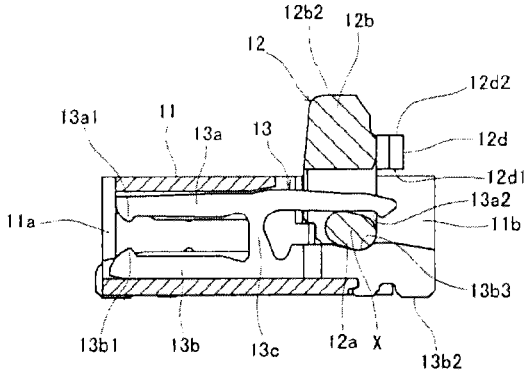
FIG. 10 is a descriptive cross-sectional view along an X-X line in FIG. 5.

Note that while the conductive contacts 13 on one side as described above are mounted by being inserted from the component mount opening 11*b* provided on the connector rear end side of the insulating housing 11 toward a front side (a left side in FIG. 10), the conductive contacts 14 on the other side are mounted by being inserted from the medium insertion opening 11*a* provided on the connector front end side of the insulating housing 11 toward a rear side (a right side in FIG. 10). These conductive contacts 13 and 14 are each disposed at a position corresponding to a wiring pattern Fa formed on the signal transmission medium (such as FPC or FFC) F inserted inside of the insulating housing 11. The wiring pattern Fa formed on the signal transmission medium F is formed by disposing conductive paths for signal transmission (signal line pads) or conductive paths for shielding (shield line pads) with appropriate pitch spaces.

Here, the conductive contacts 13 and 14 have a pair of a movable beam 13*a* and a fixed beam 13*b* and a pair of a movable beam 14*a* and a fixed beam 14*b*, respectively, each formed of an elongated beam member extending approximately in parallel along the front-back direction, which is an insertion/removal direction of the signal transmission medium F (a lateral direction in FIG. 10). These movable beams 13*a* and 14*a* and the fixed beams 13*b* and 14*b* are disposed so as to face each other as being appropriately spaced apart from each other in an inner space of the insulating housing 11 described above in a vertical direction in the drawings. Of these, the fixed beams 13*b* and 14*b* are fixed to be in an approximately unmovable state along an inner wall surface of a bottom plate of the insulating housing 11, and the movable beams 13*a* and 14*a* are integrally coupled to the fixed beams 13*a* and 13*b* via coupling support parts 13*c* and 14*c*, respectively.

The coupling support parts 13*c* and 14*c* are each formed of a plate-shaped member having a narrow width, and are disposed so as to extend in the vertical direction in the drawings in an approximately center portion in a direction in which both of the beams 13*a* and 14*a* and 13*b* and 14*b* extend. Via these coupling support parts 13*c* and 14*c*, the movable beams 13*a* and 14*a* are configured to have elastic flexibility with respect to the fixed beams 13*b* and 14*b*, respectively. These movable beams 13*a* and 14*a* are configured to be able to swing by taking the coupling support parts 13*c* and 14*c* or nearby as a rotation center. Here, the swinging of the movable beams 13*a* and 14*a* is performed in a vertical direction on paper in FIG. 10.

Also, front-end-side portions (left-end-side portions in FIG. 10) of the movable beams 13*a* and 14*a* described above are provided with upper terminal contact convex portions 13*a*1 and 14*a*1, respectively, to be connected to any wiring pattern (conductive path for signal transmission or for shielding) Fa formed on an upper side of the signal transmission medium (such as FPC or FFC) F in the drawings so as to form a downward projected shape in the drawings.

On the other hand, the fixed beams 13*b* and 14*b* as described above are disposed so as to extend in the front-back direction along the inner wall surface of the bottom plate of the insulating housing 11. Front-side portions (a left-side portion in FIG. 10) of these fixed beams 13*b* and 14*b* are provided with lower terminal contact convex parts 13*b*1 and 14*b*1, respectively, to be connected to the wiring pattern (conductive path for signal transmission or for shielding) Fa formed on a lower side of the signal transmission medium (such as FPC or FFC) F in the drawings so as to form an upward projected shape in the drawings. These lower end contact convex parts 13*b*1 and 14*b*1 are disposed so as to face positions straight below the upper terminal contact convex parts 13*a*1 and 14*a*1 on movable beams 13*a* and 14*a* sides, respectively, in the drawings. Between these upper and lower terminal contact convex parts 13*a*1 and 13*b*1 and upper and lower terminal contact convex parts 14*a*1 and 14*b*1, the signal transmission medium F is pinched.

Note that these upper and lower terminal contact convex parts 13*a*1 and 13*b*1 of the movable beam 13*a* and the fixed beam 13*b* and upper and lower terminal contact convex parts 14*a*1 and 14*b*1 of the movable beam 14*a* and the fixed beam 14*b* can be disposed so as to be shifted in position to a connector front side (a left side in FIG. 10) or a connector rear side (a right side in FIG. 10). Also, while the fixed beams 13*b* and 14*b* are fixed basically in an unmovable state, their tip portion can be formed so as to be able to be elastically displaced for the purpose of facilitating insertion of the signal transmission medium (such as FPC or FFC) F or other purposes. The front end portion of each of the fixed beams 13*b* and 14*b* can also be formed so as to slightly float from the inner wall surface of the bottom plate of the insulating housing 11.

Figure 12:
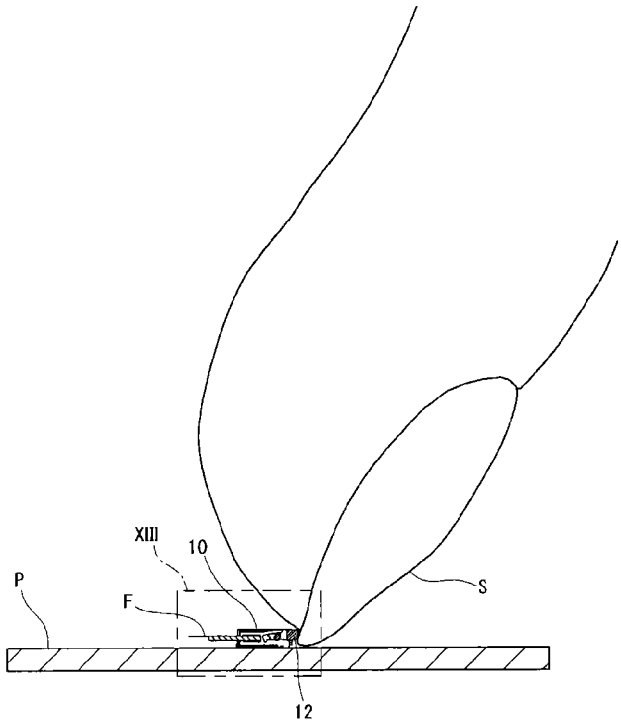
FIG. 12 is a descriptive cross-sectional view showing an operation of pulling up the actuator depicted in FIG. 2 and FIG. 9 pushed down to the connection acting position with a nail of an operator.
Figure 13:
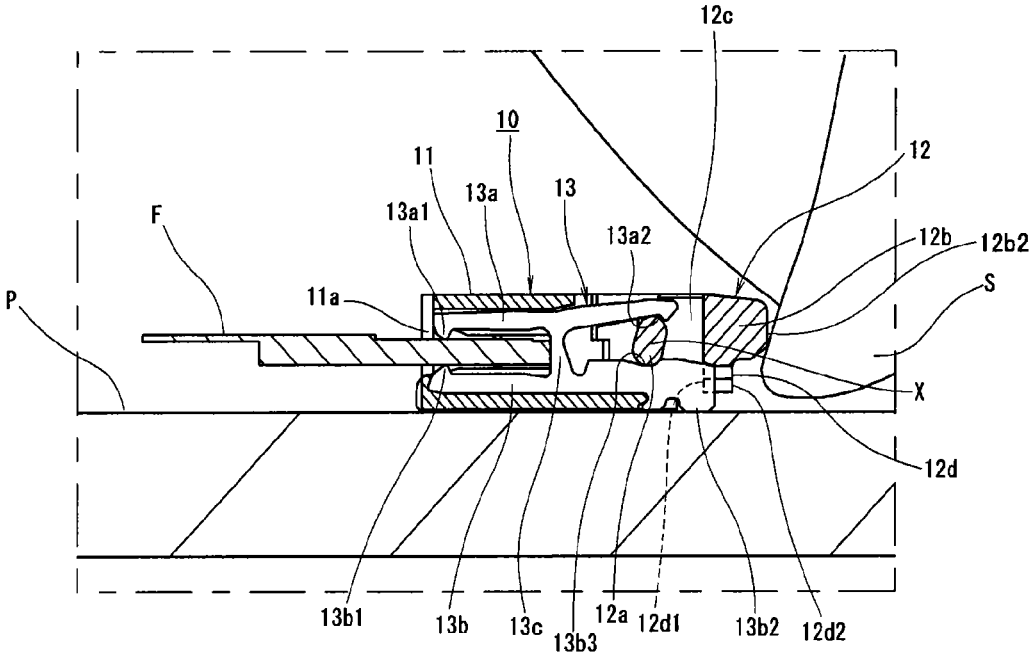
FIG. 13 is a descriptive enlarged cross-sectional view of a region denoted as a reference character III in FIG. 12, showing one conductor contact.
Figure 14:
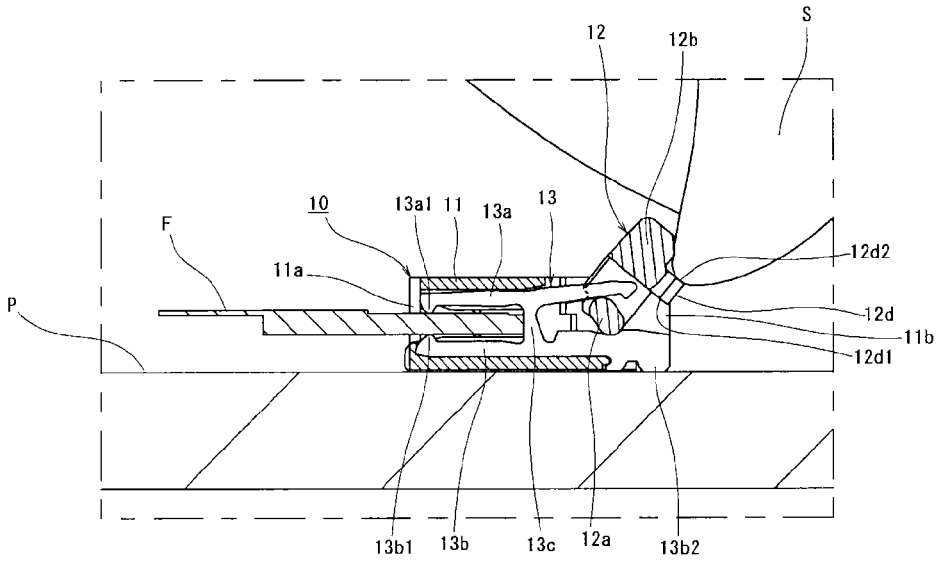
FIG. 14 is a descriptive cross-sectional view of the state where, from the state of being pushed down to the connection acting position in FIG. 13, the actuator is slightly pulled up.
Figure 15:
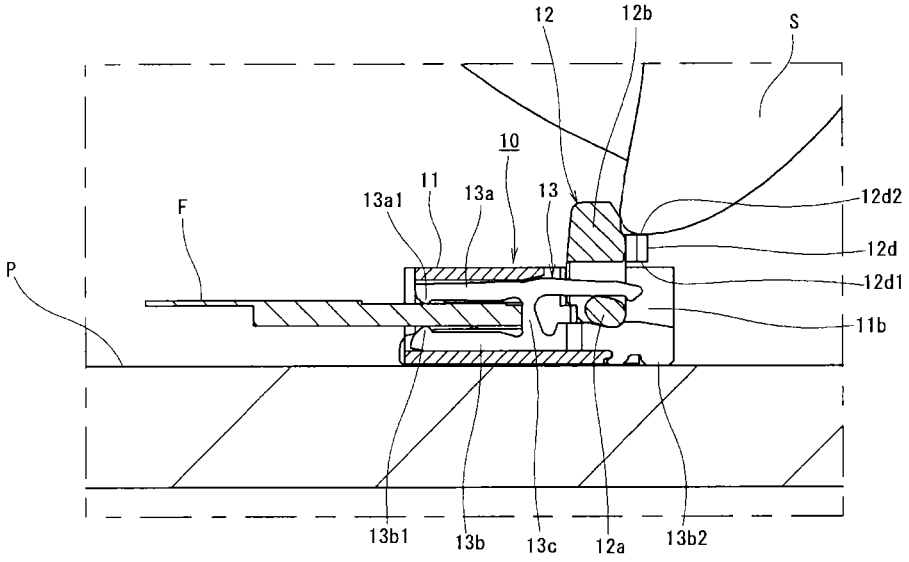
FIG. 15 is a descriptive cross-sectional view corresponding to FIG. 13, showing the state where the actuator is pulled up to the connection release position.
Figure 16:
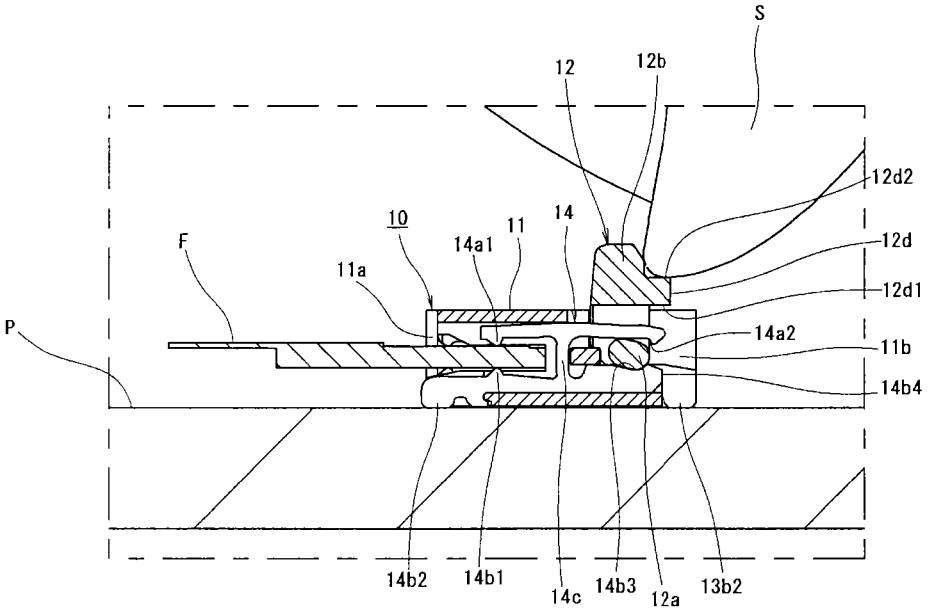
FIG. 16 is a descriptive cross-sectional view corresponding to FIG. 15, the view showing the state where the actuator is pulled up to the connection release position and showing another conductive contact.
Figure 17:
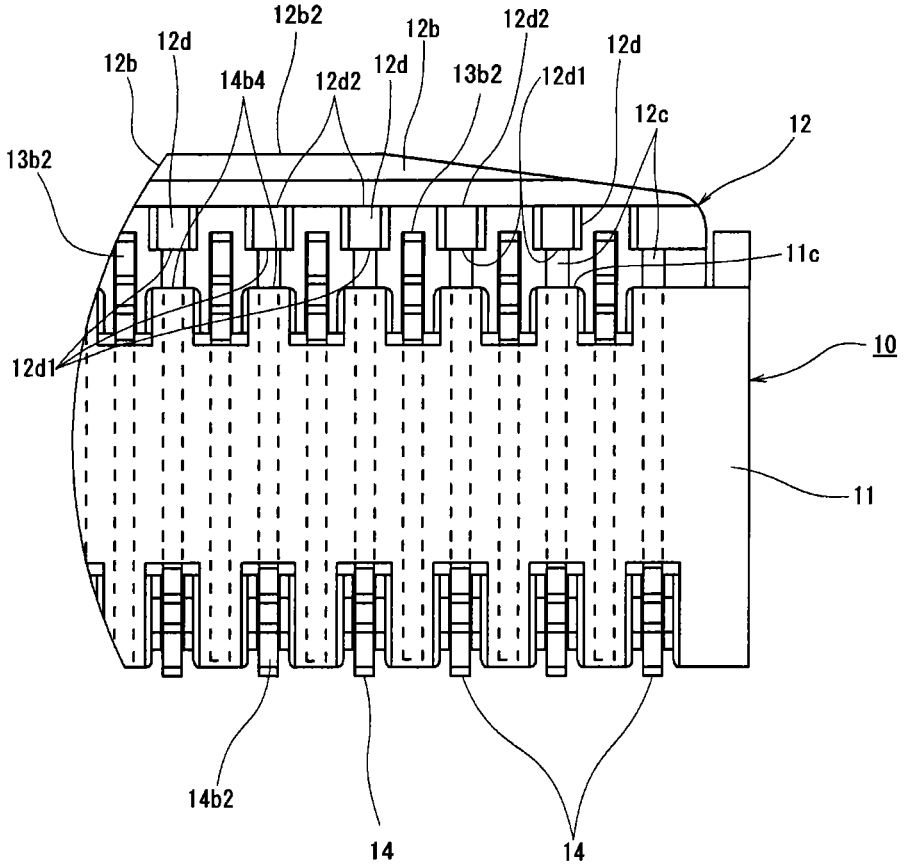
FIG. 17 is a descriptive partial bottom view of the state where the actuator is pushed down to the connection acting position, when viewed from a lower side.

Furthermore, a rear-end-side portion (a right-end-side portions in FIG. 10) of the fixed beam 13*b* and a front-end-side portion (a left-end-side portion in FIG. 10) of the fixed beam 14*b* described above are provided with board connecting parts 13*b*2 and 14*b*2, respectively, to be connected by solder to a conductive path formed on the main wiring board (refer to the reference character P in FIG. 12 and FIG. 13).

Still further, rear-end-side portions (right-end-side portions in FIG. 10) of the movable beams 13*a* and 14*a* are provided with cam receiving portions 13*a*2 and 14*a*2, respectively, and rear-end-side portions (right-end-side portions in FIG. 10) of the fixed beams 13*b* and 14*b* are provided with cam receiving concave portions 13*b*3 and 14*b*3, respectively formed so as to each form a concave shape. In these cam receiving parts 13*a*2 and 14*a*2 and cam receiving concave parts 13*b*3 and 14*b*3, a pressing cam part 12*a* of the actuator (connecting operation device) 12 mounted at the rear end portion of the insulating housing 11 described above is disposed in contact. A cam surface formed along an outer perimeter of this pressing cam part 12*a* is slidably in contact with the cam receiving parts of the movable beams 13*a* and 14*a* and the cam receiving concave parts 13*b*3 and 14*b*3 of the fixed beams 13*b* and 14*b*. With this contact arrangement relation, the actuator 12 is rotatably supported about a rotation center X of the pressing cam part 12*a* (refer to FIG. 10 and FIG. 11).

Figure 11:
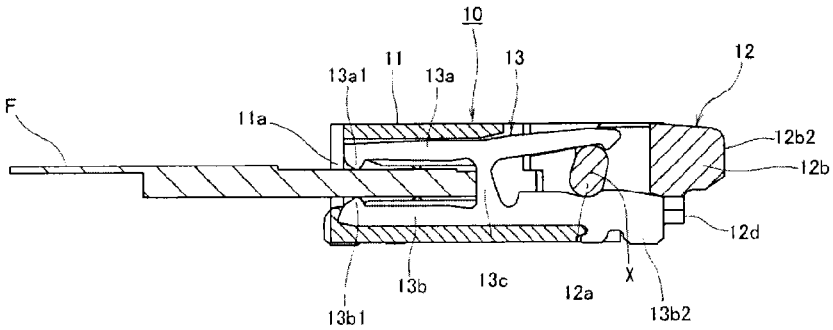
FIG. 11 is a descriptive cross-sectional view along an XI-XI line in FIG. 7.

Here, as depicted in FIG. 11, the cam receiving parts 13*a*2 and 14*a*2 of the movable beams 13*a* and 14*a* and the cam receiving concave parts 13*b*3 and 14*b*3 of the fixed beams 13*b* and 14*b* described above are lightly engaged with the pressing cam part 12*a* rotated to the "connection acting position", thereby holding the pressing cam part 12*a* in the state of being rated up to the "connection acting position" in FIG. 10.

On the other hand, the entire actuator (connecting operation device) 12 disposed as being rotated at the rear end portion (the right-end-side portion in FIG. 10 and FIG. 11) of the insulating housing 11 as described above is formed so as to extend in an elongated shape along the connector longitudinal direction, and is disposed over an approximately same length as the full width of the insulating housing 11. This actuator 12 is mounted so as to be above to move about a rotation center extending in a longitudinal direction of the actuator 12, that is, the rotation center X (refer to FIG. 10 and FIG. 11) of the pressing cam part 12*a* described above, with a portion outside the rotation radius regarding the rotation center X (a right-end-side portion in FIG. 11) is formed as an open/close operating part 12*b*. With an appropriate operating force being added by the operator to the open/close operating part 12*b*, the entire actuator 12 is rotated so as to reciprocate between the "connection release position" at which the actuator 12 stands approximately upright as depicted in FIG. 10 and the "connection acting position" at which the actuator 12 is fallen down approximately horizontally toward a connector rear side as depicted in FIG. 11.

Here, in a portion of the open/close operating part 12*b* coupled to the pressing cam part 12*a*, a slit-shaped through hole part 12*c* is formed for avoiding interference with the conductive contacts 13 and 14. When the actuator 12 is rotated to the "connection release position" (refer to FIG. 10), the rear end portions of the movable beams 13*a* and 14*a* of the conductive contacts 13 and 14 enter the inside of the slit-shaped through hole part 12*c*.

On the other hand, it is configured that when the open/close operating part 12*b* of the actuator (connecting operation device) 12 is operated to be rotated by hand of the operator so as to be pressed down from the "connection release position" (refer to FIG. 10) toward the "connection acting position" (refer to FIG. 11), the rotation radius of the pressing cam part 12*a* described above is changed in a direction of increasing between the fixed beams 13*b* and 14*b* and the movable beams 13*a* and 14*a*, respectively. Then, according to the change of increasing the radius of the pressing cam part 12*a*, the cam receiving parts 13*a*2 and 14*a*2 provided on the rear end sides of the movable beams 13*a* and 14*a*, respectively are displaced so as to be lifted up to an upper side in the drawings. Accordingly, the upper terminal contact convex parts 13*a*1 and 14*a*1 provided on a side (a connector front end side) opposite to the cam receiving parts 13*a*2 and 14*a*2 are pushed downward.

If the actuator (connecting operation device) 12 has been completely rotated to the "connection acting position", which is a final rotation position (refer to FIG. 10), the signal transmission medium (such as FPC or FFC) F inserted between the upper terminal contact convex parts 13*a*1 and 14*a*1 of the movable beams 13*a* and 14*a* and the lower terminal contact convex parts 13*b*1 and 14*b*1 of the fixed beams 13*b* and 14*b*, respectively, is pinched. At this time, the upper terminal contact convex parts 13*a*1 and 14*a*1 and the lower terminal contact convex parts 13*b*1 and 14*b*1 are press-contacted with the wiring pattern of the signal transmission medium F (conductive path for signal transmission or for shielding) Fa, thereby establishing an electrical connection.

As described above, the open/close operating part 12*b* of the actuator 12 extends long along the connector longitudinal direction. On an operation-side end face disposed outside of a radial direction regarding the rotation center X of the open/close operating part 12*b*, that is, an upper end face with the actuator 12 standing at the "connection release position" (refer to FIG. 4 and FIG. 5), inclined surface parts 12*b*1 are provided on both end portions in the connector longitudinal direction. These inclined surface parts 12*b*1 are each formed so as to go down toward outside in the connector longitudinal direction, which is an extending direction of the actuator 12, and so as to extend to form an appropriate angle with respect to the connector longitudinal direction. On a portion between these inclined surface parts 12*b*1 and 12*b*1, a flat part 12*b*2 is provided to extend in the connector longitudinal direction, which is the extending direction of the actuator 12.

Here, the appropriate angle of each inclined surface part 12*b*1 with respect to the longitudinal direction, that is, an angle with respect to a horizontal line obtained by extending the flat part 12*b* described above, is set in a range of 4 degrees to 15 degrees in the present embodiment. The reason for this setting of the inclined angle is that it has been found that when the actuator 12 is actually operated as being rotated, excellent uniformity of the operation pressing force over the full length of the actuator 12 and stiffness of the full length of the actuator 12 can be both obtained simultaneously.

When the actuator 12 is rotated from the "connection release position" to the "connection acting position", the front end face (the left-side end face in FIG. 10) of the actuator 12 with the actuator 12 standing at the "connection release position" (refer to FIG. 10) is pressed with a fingertip of the operator. If the inclined surface parts 12*b*1 are provided on both end portions of the open/close operating part 12*b* of the actuator 12 as described above, the pressing force of the operator is difficult to be exerted onto a portion where the inclined surface parts 12*b*1 are provided. With this, the pressing force tends to be loaded onto a portion where the flat part 12*b*2 disposed at the center portion in the connector longitudinal direction is disposed. Also, the pressing force loaded onto portions where the inclined surface parts 12*b*1 are provided is added in an approximately right angle direction with respect to the inclined surfaces of the inclined surface parts 12*b*1, that is, toward the both end sides to a center side in the connector longitudinal direction. For this reason, the pressing force by the operator approximately uniformly acts over the entire actuator 12, making it difficult to cause a situation that the actuator 12 is pressed as being twisted. The actuator 12 is rotated as a whole by keeping an approximately flat plane. As a result, the action of pinching the signal transmission medium (such as FPC or FFC) F by the rotation of the actuator 12 is excellently performed.

Figure 7:
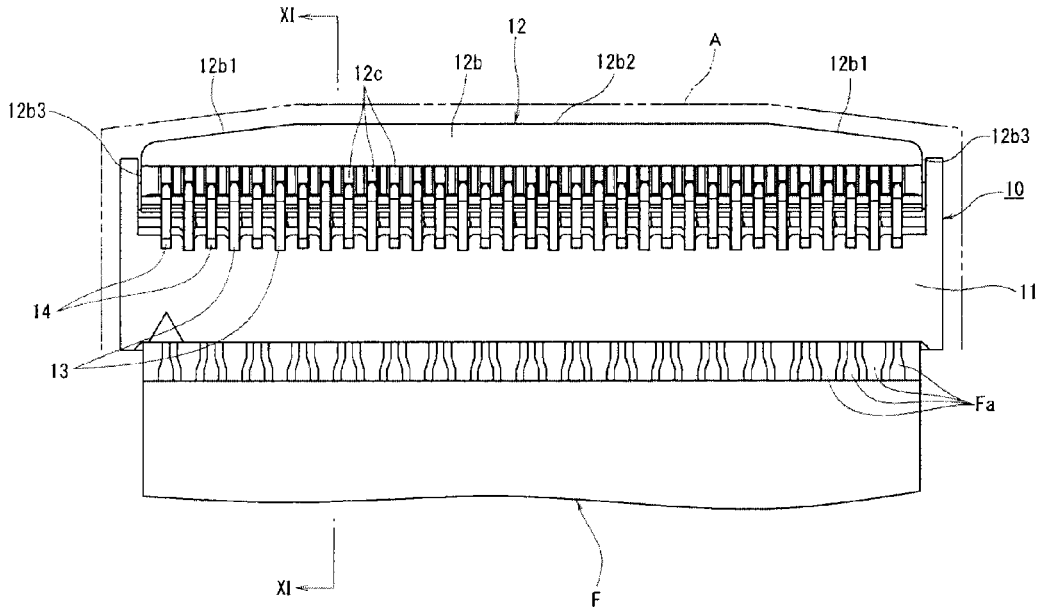
FIG. 7 is a descriptive external perspective view of the electric connector in a connection acting state depicted in FIG. 2 when viewed from an upper side.
Figure 8:
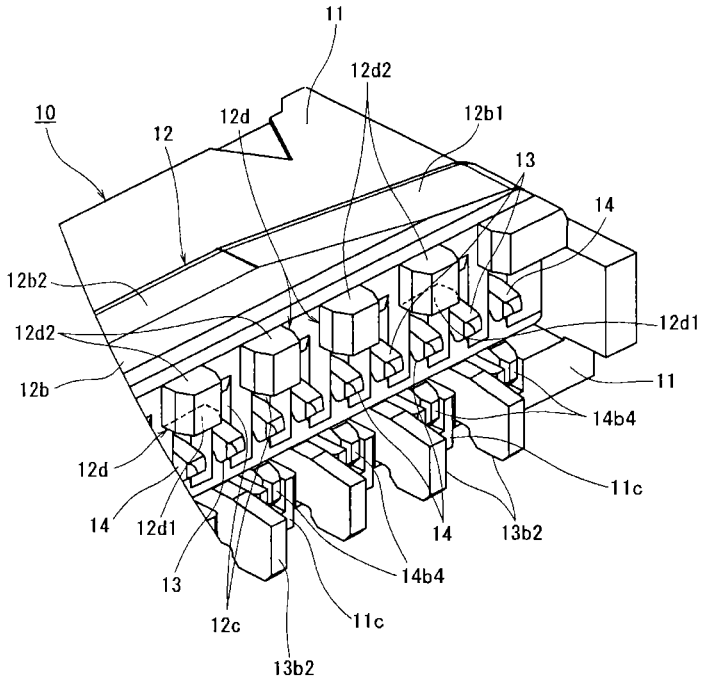
FIG. 8 is a descriptive enlarged external perspective view of an end portion in a longitudinal direction of the electric connector in the connection release state depicted in FIG. 3.
Figure 9:
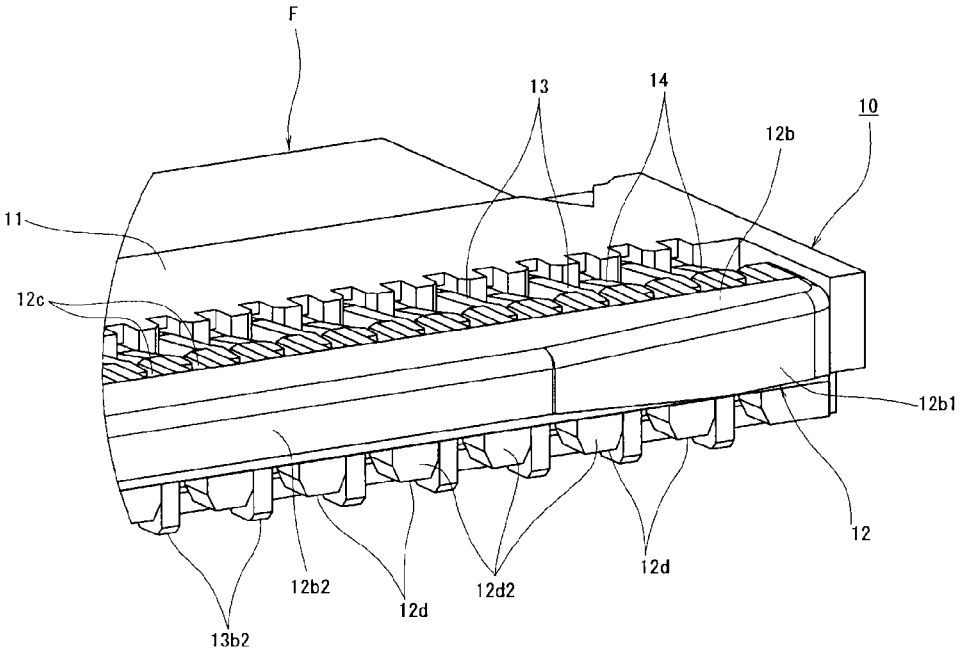
FIG. 9 is a descriptive enlarged external perspective view of an end portion in a longitudinal direction of the electric connector in the connection acting state depicted in FIG. 6.

Furthermore, when the entire external view of the actuator 12 is visually checked, in particular, as depicted with a two-dot-chain line denoted as a reference character A in FIG. 7, it is visually recognized as having an odd form with an approximately trapezoidal shape. In particular, with the actuator 12 being rotated to the "connection acting position" (refer to FIG. 7), the entire external view of the actuator 12 is visually conspicuous as having an approximately trapezoidal shape in a planar view. Therefore, the rotation state of the actuator 12 to the "connection acting position" is easily and reliably checked.

Still further, the inclined surface parts 12*b*1 disposed on both end sides in the connection longitudinal direction described above are formed so as to smoothly continue from both end parts of the flat part 12*b*2 provided on the center side in the connector longitudinal direction, and no corner is formed at a boundary between the surface parts 12*b*1 and 12*b*2.

As such, with the structure in which the inclined surface parts 12*b*1 smoothly continue from the flat part 12*b*2, if the operating force is loaded onto the actuator 12, no concentration of stress occurs at a boundary between the surface parts 12*b*1 and 12*b*2, thereby making it possible to prevent damage on the actuator 12 and others.

Still further, on both end edge parts of the open/close operating part 12*b* provided to the actuator 12 in the connector longitudinal direction, rising surface parts 12*b*3 forming an approximately flat shape are provided. These rising surface parts 12*b*3 are each formed so as to extend along a rotational radial direction of the actuator 12. That is, with the actuator 12 standing at the "connection release position" (refer to FIG. 4 and FIG. 5), each rising surface part 12*b*3 is formed so as to extend upward approximately in a vertical direction from the upper surface of the insulating housing 11 described above. From an upper end part of each rising surface part 12*b*3, the inclined surface part 12*b*1 is contiguously provided.

With the inclined surface parts 12*b*1 being provided via the rising surface parts 12*b*3 as described above, the stiffness in the open/close operating part 12*b* of the actuator 12 can be increased accordingly to the provision of the rising surface parts 12*b*3, thereby making it possible to prevent damage and others when the operating force is loaded onto the actuator 12.

On the other hand, with the actuator 12 being rotated so as to be pushed down from the "connection release position" (refer to FIG. 10) toward the rear side and moved to the "connection acting position" (refer to FIG. 11) as described above, a lower-surface-side portion of the open/close operating part 12*b* of the actuator 12 in the drawings are disposed so as to have a relation of facing close to a main wiring board P. Here, on the lower-surface-side portion of the open/close operating part 12*b* of the actuator 12, protective projections 12*d* protruding toward the main wiring board P are provided. These plurality of protective projections 12*d* are disposed a predetermined space apart from each other in the multi-contact arrangement direction of the conductive contacts 13 and 14 (connector longitudinal direction) described above. The protective projections 12*d* each formed as a block body having a shape of an approximately quadrangular prism are integrally rotated according to the rotating operation of the actuator 12.

More specifically, each protective projection 12*d* is disposed at a position corresponding to the conductive contact 14 having the shape on the other side described above in the connector longitudinal direction, that is, in the multi-contact arrangement direction of the conductive contacts 13 and 14. That is, the protective projection 12*d* is disposed between the board connecting parts 13*b*2 of adjacent conductive contacts 13 having the shape on one side in the multi-contact arrangement direction. Therefore, when the protective projections 12*d* are rotated together with the entire actuator 12, the state of non-interference is always kept with respect to the board connecting part 13*b*2 of each conductive contact 13 on one side.

Also, for each conductive contact 14 having the shape on the other side, an inner end face 12*d*1 inside of the rotation radius of each protective projection 12*d* is disposed at a non-interfering position corresponding to the rear side (the right side in FIG. 16) of the conductive contact 14. That is, with the actuator 12 being at the "connection acting position", the inner end face 12*d*1 of the protective projection 12*d* is disposed so as to face at a position slightly away from a rear end face (an upper end face in FIG. 17) 14*b*4 of the fixed beam 14*b* configuring the conductive contact 14 on the other side, to a rear side (an upper side in FIG. 17). With this facing arrangement relation in which both end faces are spaced apart from each other, a non-interference state with respect to the conductive contact 14 on the other side can be kept.

Furthermore, an arrangement relation is such that a rear end edge part (an upper end edge part in FIG. 17) 11*c* of the bottom plate of the insulating housing 11 in which the conductive contact 14 on the other side is held is positioned in the connector front-back direction (a horizontal direction in FIG. 16) to approximately match with a rear end face (an upper end face in FIG. 17) 14*b*4 of the conductive contact 14 on the other side. Therefore, also for the rear end edge part (the upper end edge part in FIG. 17) 11*c* of the bottom plate of the insulating housing 11, the inner end face 12*d*1 of the protective projection 12*d* described above is disposed so as to face at a position slightly away to the rear side (the upper side in FIG. 17). With this facing arrangement relation in which both end faces are spaced apart from each other, a non-interference state of each protective projection 12*d* with respect to the insulating housing 11 is kept.

Still further, an outer end face 12*d*2 of each protective projection 12*d* provided outside the rotation radius is disposed at a position drawn slightly inward (leftward in FIG. 10 and FIG. 13) from an operation-side outer end face 12*b*4 (a right end face in FIG. 10 and FIG. 13) of the open/close operating part 12*b* of the actuator 12 also outside the rotation radius. The outer end face 12*d*2 of each protective projection 12*d* is provided so as to form a step on the operation-side outer end face 12*b*4 of the open/close operating part 12*b* of the actuator 12. In particular, as depicted in FIG. 13, a nail S of the operator is easily hooked, from a lower side, at the step formed of the protective projection 12*d* described above and a portion outside the rotation radius from that step.

The outer end face 12*d*2 of the protective projection 12*d* forming this step is disposed at a position slightly protruding from the rear end face (the right end face in FIG. 10 and FIG. 13) of the board connecting part 13*b*2 provided on each conductive contact 13 on one side described above toward the rear side of the actuator 12 (the right side in FIG. 10 and FIG. 13), that is, toward an operation-side outer end face 12*b*4 side of the actuator 12 with the actuator 12 being moved to the "connection acting position". Therefore, when the nail S of the operator is inserted toward the inside of the connector (a left side in FIG. 13), the nail S of the operator abuts on the outer end face 12*d*2 of the protective projection 12*d*. Therefore, the nail S of the operator is prevented from being in contact with the board connecting part 13*b*2 of the conductive contact 13. A flat part 12*b*2, which smoothly continues from the operation-side outer end face of the actuator 12 and extends in a parallel along the inner end face 12*d*1 of the protective projection 12*d*, is arranged at nearer position to the board connecting parts 13*b*2 than the inner end face 12*d*1.

Also, the nail S of the operator abuts on the outer end face 12*d*2 of the protective projection 12*d*. Therefore, when the actuator 12 is rotated from the "connection acting position" to the "connection release position", a situation is prevented that the nail S of the operator enters a pressing cam portion 12*a* side from the outer end face 12*d*2 to become contact with the movable beams 13*a* and 14*a* of the conductive contact protruding from the slit-shaped through hole part 12*c* of the actuator 12.

As such, according to the present embodiment, the gap formed between the actuator 12 and the main printed wiring board P is covered with the protective projection 12 provided to the actuator 12 from the rear side (the right side in FIG. 13) of the actuator 12. With this, a chance is eliminated that the nail S of the operator is in contact with a connector component such as the conductive contacts 13 and 14 disposed inside the gap between the actuator 12 and the main printed wiring board P.

Also, the protective projection 12*d* in the present embodiment is provided so as to form a step on the operation-side outer end face 12*b*4 of the open/close operating part 12*b* of the actuator 12. With this, when an operation of rotating the actuator 12 is performed, a nail tip part of the operator is easily hooked at the step between the actuator 12 and the protective projection 12*d*, and thus the operation of rotating the actuator 12 is safely and reliably performed.

Furthermore, in the present embodiment, the protective projection 12*d* is disposed at a portion between board connecting parts 13*b*2 of adjacent ones of the conductive contacts 13 in the multi-contact arrangement direction. With this, when the actuator 12 is moved to the "connection acting position", the protective projection 12*d* of the actuator 12 enters the portion between the board connecting parts 13*b*2 of the conductive contacts 13 to prevent interference between the actuator 12 and the conductive contacts 13. Therefore, even if the actuator 12 is reduced in a length direction of the conductive contacts 13 orthogonal to the multi-contact arrangement direction, no interference occurs. Also, the portion between the board connecting parts 13*b*2 of the conductive contacts 13 is covered with the protective projection 12*d* of the actuator 12, and thus a situation is prevented that a foreign substance such as dust enters that portion to cause an electric short circuit.

Still further, the protective projection 12*d* in the present embodiment is disposed so as to protrude to an operator side of the actuator 12 from the rear end face of the board connecting part 13*b*2 of each conductive contact 13. With this, the tip of the nail S of the operator is in contact with the protective projection 12*d* of the actuator 12 to disable further insertion, and therefore the tip of the nail S of the operator is reliably prevented from being in contact with the end face of the board connecting part 13*b*2 of the conductive contact 13.

In addition, the protective projection 12*d* in the present embodiment is disposed at a position not interfering with the insulating housing 11 in the reciprocating rotation direction of the actuator 12. With this, it is not required to decrease the size of the insulating housing 11 to avoid interference with the protective projection 12*d* of the actuator 12 and, accordingly, the ability of holding the conductive contacts 13 and 14 is excellently kept.

While the invention made by the inventor has been specifically described based on the embodiment, the present invention is not meant to be restricted to the embodiment described above, and it goes without saying that the present invention can be variously modified within a range not deviating from the gist of the invention.

For example, in the embodiment described above, while a flexible printed circuit (FPC) or a flexible flat cable (FFC) is adopted as a signal transmission medium to be fixed to the electric connector, the present invention can be similarly applied to the case in which another medium for signal transmission or the like is used.

Also, while the connecting operation device in the embodiment described above is configured of an actuator to be operated as being rotated, the present invention can be similarly applied to an electric connector having connecting operation device to be operated as being slid. Similarly, the present invention can be similarly applied to an electric connector in which the connecting operation device (actuator) is disposed at a front end portion and an electric connector in which the connecting operation device (actuator) is disposed at a portion between the front end portion and a rear end portion. Furthermore, a rotating direction or a sliding direction may be oriented toward a front side or a rear side.

Furthermore, while the conductive contacts having different shapes are used in the electric connector according to the embodiment described above, the present invention can be similarly applied even when conductive contacts having the same shape are used.

The present invention can be widely applied to various types of electric connectors for use in various electric apparatuses.

What is claimed is:

1. An electric connector for being mounted on a wiring board so as to connect a signal transmission medium to a wiring board side, the electric connector being configured so that an actuator pinches the signal transmission medium by being moved to a connection acting position so as to face the wiring board, wherein said actuator is mounted on an insulating housing so as to be able to reciprocate, a plurality of conductive contacts, including a first conductive contact and a second conductive contact in contact with the signal transmission medium and the wiring board, are disposed in the insulating housing in a multi-polar manner, the first conductive contact and the second conductive contact having different shapes and alternately arranged in the multi-polar direction, the first and second conductive contacts each have a board connecting part jointed to the wiring board by soldering, wherein the actuator is provided with a protective projection protruding toward the wiring board with the actuator being moved to the connection acting position so as to form a step on an operation-side outer end face of the actuator, and wherein the protective projection forming the step, which has a length over a part of a span of a length of the actuator in a direction perpendicular to the multi-polar arrangement direction, is disposed at a portion between the adjacent board connecting parts of the first conductive contacts in the multi-polar arrangement direction with the actuator being moved to the connection acting position, and in the state that the protective projection being disposed at a position between the adjacent board connecting parts of the first conductive contacts, a) the board connecting parts of the first conductive contacts are exposed outside from an inner end face of the protective projection, b) the inner end face of the protective projection is disposed so as to face to a rear end face of the second conductive contact, c) an outer end face of the protective projection, over the entire height of the protective projection in a direction perpendicular to a face of the wiring board is projected outside from a rear end face of the board connecting parts of the first conductive contacts, and the inner end face and the outer end face of the protective projection, with the actuator being moved to the connection acting position, are disposed so as to extend in a direction perpendicular to a face of the wiring board.

2. The electric connector according to claim 1, wherein the protective projection is disposed to protrude to an operation-side outer end face side of the actuator with the actuator being moved from an end face of a board connecting part of each of the conductive contacts to the contact acting position.

3. The electric connector according to claim 1, wherein the actuator is mounted on the insulating housing so as to be able to reciprocate, and the protective projection is disposed at a position not interfering with the insulating housing in a reciprocating direction of the actuator.

4. The electric connector according to claim 1, wherein the actuator is provided so as to be able to rotate about a rotation center extending in a longitudinal direction of the actuator, and inclined surface parts extending to form an appropriate angle with respect to the longitudinal direction are provided on both end portions of the actuator in the longitudinal direction on an outer-side end face in a radial direction with respect to the rotation center of the actuator.

5. The electric connector according to claim 1, wherein, the operation-side outer end face of the actuator on which the protective projection is formed is extending in a direction perpendicular to the inner end face and the outer end face of the protective projection.

6. The electric connector according to claim 1, wherein a flat part, which smoothly continues from the operation-side outer end face of the actuator and extends in a parallel along the inner end face of the protective projection, is arranged at nearer position to the board connecting parts than the inner end face.

7. The electric connector according to claim 1, wherein the protective projection is arranged so as to enter to the operation-side space which is a part of the space between a pair of the board connecting parts of the first conductive contacts, with the actuator being moved to the connection acting position.

* * * * *